US006997391B1

(12) United States Patent
Bosshart

(10) Patent No.: US 6,997,391 B1
(45) Date of Patent: Feb. 14, 2006

(54) RAILROAD CROSSING FLANGEWAY LINER

(75) Inventor: John H. Bosshart, North Richland Hills, TX (US)

(73) Assignee: BNSF Railway Company, Fort Worth, TX (US)

( * ) Notice: Subject to any disclaimer, the term of this patent is extended or adjusted under 35 U.S.C. 154(b) by 24 days.

(21) Appl. No.: 10/792,095

(22) Filed: Mar. 3, 2004

Related U.S. Application Data

(60) Provisional application No. 60/451,592, filed on Mar. 3, 2003.

(51) Int. Cl.
*E01C 9/04* (2006.01)

(52) U.S. Cl. ..... 238/8; 238/7; 238/2

(58) Field of Classification Search ..... 238/2, 238/4, 5, 7, 8, 9, 324, 382
See application file for complete search history.

(56) References Cited

U.S. PATENT DOCUMENTS

| | | | | |
|---|---|---|---|---|
| 3,353,747 A * | 11/1967 | Speer | ..... | 238/8 |
| 4,793,545 A * | 12/1988 | Raymond | ..... | 238/8 |
| 5,813,602 A * | 9/1998 | Holland | ..... | 238/8 |
| 6,439,470 B1 * | 8/2002 | Hull | ..... | 238/8 |
| 6,588,677 B1 * | 7/2003 | Hofstetter et al. | ..... | 238/283 |
| 6,871,791 B1 * | 3/2005 | Egan, Jr. | ..... | 238/8 |

* cited by examiner

*Primary Examiner*—Frantz F. Jules

(74) *Attorney, Agent, or Firm*—James J. Murphy; Thompson & Knight LLP

(57) ABSTRACT

An ultrahigh molecular weight polyethylene material is utilized in a railroad flangeway to reduce the wear of a railroad crossing base.

15 Claims, 2 Drawing Sheets

RAILROAD CROSSING FLANGEWAY LINER

CROSS REFERENCE

This application claims the benefit of U.S. Provisional Patent Application Ser. No. 60/451,592, filed 3 Mar. 2003, entitled "Highway Crossing Flangeway Liner."This provisional application is incorporated herein as if fully set forth.

BACKGROUND

1. Field of the Invention

The present invention relates to railroad crossings. In particular, the present invention relates to railroad crossing flangeway liners.

2. Description of Related Art

The railroad industry is constantly working to make railroad crossings safe and effective. In the past, these crossings were made of wood and rubber. Over the years, the railroad industry has upgraded many of these crossings from wood and rubber to concrete. These concrete railroad crossings are typically constructed by securing the rails to either a concrete base or concrete ties and securing concrete panels between the rails.

A clearance, called a flangeway, must exist between the inside edge of each rail and the concrete panel to allow for the flanges of the railcar wheels. Steel guard strips are embedded into the top corners of the concrete panels opposite the inside edge of each rail to prevent damage to the concrete panel from the flanges of the railcar wheels. This crossing configuration provides a strong and durable base for the rails, while providing a smooth and stable roadway. The flangeway is typically at least three inches in width. If the flangeway is less than about three inches in width, the inside edges and the flanges of the railcar wheels can impact the steel guard strip causing damage to the concrete panel. If the central concrete panels get damaged, the crossing can become dangerous to both railroad traffic and roadway traffic. In addition, repairing the concrete panels is very costly and time consuming.

Although there have been many developments in the area of railroad crossings, many shortcomings remain.

SUMMARY OF THE INVENTION

There is a need for a railroad crossing in which the flangeway width can be maintained at about three inches or less.

Therefore, it is an object of the present invention to provide a railroad crossing in which the flangeway width can be maintained at about three inches or less.

This object is achieved by providing a concrete railroad crossing having a flangeway that is lined with ultra high molecular weight polyethylene (UHMWPE).

The present invention provides significant advantages over the prior art, including: (1) the UHMWPE liner allows flangeway widths of less than three inches; (2) the UHMWPE liner reduces wear of flangeway components; (3) the UHMWPE liner allows the use of a rubber shock absorber; (4) the UHMWPE liner protects the concrete panel from damage; and (5) the UHMWPE liner allows flangeway widths that are smoother and safer for roadway, pedestrian, and handicapped individual traffic.

DETAILED DESCRIPTION OF THE PREFERRED EMBODIMENT

Figure 1:
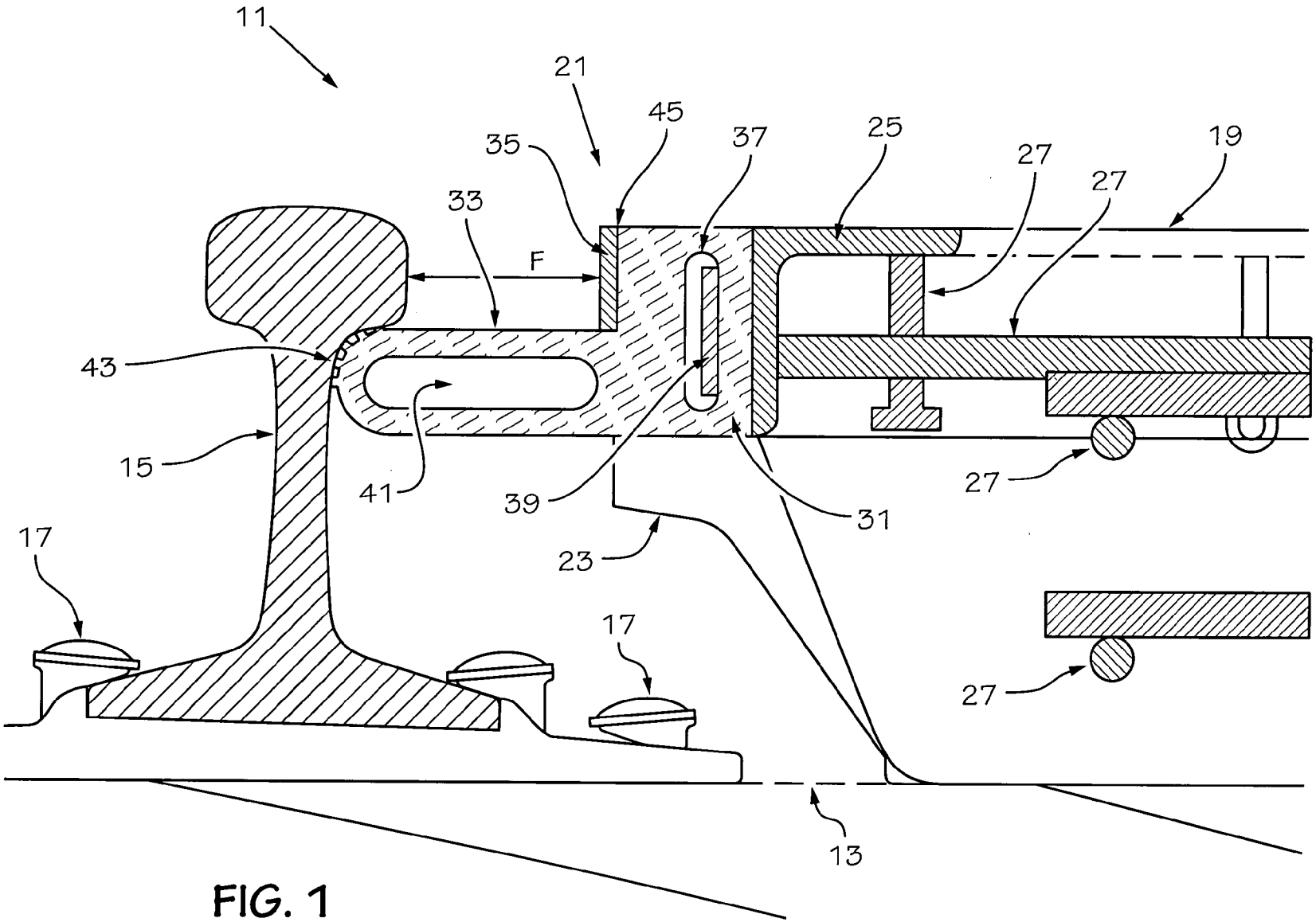
FIG. 1 is a cross-sectional view of the preferred embodiment of a railroad crossing having a UHMWPE flangeway liner according to the present invention.

Referring to FIG. 1 in the drawings, the preferred embodiment of a railroad crossing 11 having a UHMWPE liner according to the present invention is illustrated in a partial cross-sectional view. For clarity, only one side of railroad crossing 11 is illustrated. It will be appreciated that the other side is a mirror image of the side illustrated. Railroad crossing 11 includes a base 13, a rail 15, a rail clip assembly 17, a central panel 19, and a liner assembly 21. Base 13 is a concrete and/or steel substructure, and may be a plurality of concrete railroad ties. Rail 15 is secured to base 13 by rail clip assembly 17. Central panel 19 is preferably a concrete panel that is disposed between the rails 15. Central panel 19 preferably includes a blockout portion 23 that extends transversely outward from central panel 19 toward rail 15. Liner assembly 21 is carried by central panel 19, preferably at blockout portion 23. A reinforcement member 25, preferably a steel angle member, is disposed along the upper outside corner of central panel 19 to provide additional strength to central panel 19. Central panel 19 may include internal reinforcement members 27.

Liner assembly 21 includes a base portion 31, a support arm 33, and a UHMWPE liner 35. Base portion 31 and support arm 33 are preferably made of rubber or a similar pliable material. Base portion 31 includes a void space 37 for receiving an attachment bar 39 that functions as a washer. Attachment bar 39 includes a plurality of apertures (not shown) that allow attachment bar 31 to be fastened to reinforcement member 25 with conventional fasteners (not shown). Support arm 33 may also include one or more void spaces 41 to provide additional flexibility to support arm 33. In the preferred embodiment, support arm 33 extends outward from base portion 31 to form a positive seal with rail 15. Support arm 33 may include a knurled edge 43 to facilitate the sealing of support arm 33 to rail 15.

Liner 35 is preferably a thin strip of UHMWPE that is bonded to an upper vertical edge 45 of base portion 31 by suitable means. Liner 35 is preferably about one-fourth of an inch thick and about one and one-half inches high. Liner 35 preferably extends along the full length of central panel 19 opposite and parallel to rail 15. The clearance F between the inside edge of rail 15 and the outside vertical edge of liner 35 is defined as a flangeway. The flange of the railcar wheel (not shown) passes through the flangeway as the railcar travels along rail 15. The pliable nature of base portion 31 allows base portion 31 to absorb impact from the railcar wheels, thereby minimizing damage to central panel 19. If base portion 31 undergoes excessive wear, damage to central panel 19 is possible. Liner 35 prevents wear of base portion 31. With UHMWPE liner 35, the clearance F of the flangeway can be less than three inches while providing sufficient wear protection to base portion 31 and damage protection to central panel 19. For example, flangeway clearance F can be two and three-fourths inches wide.

Figure 2:
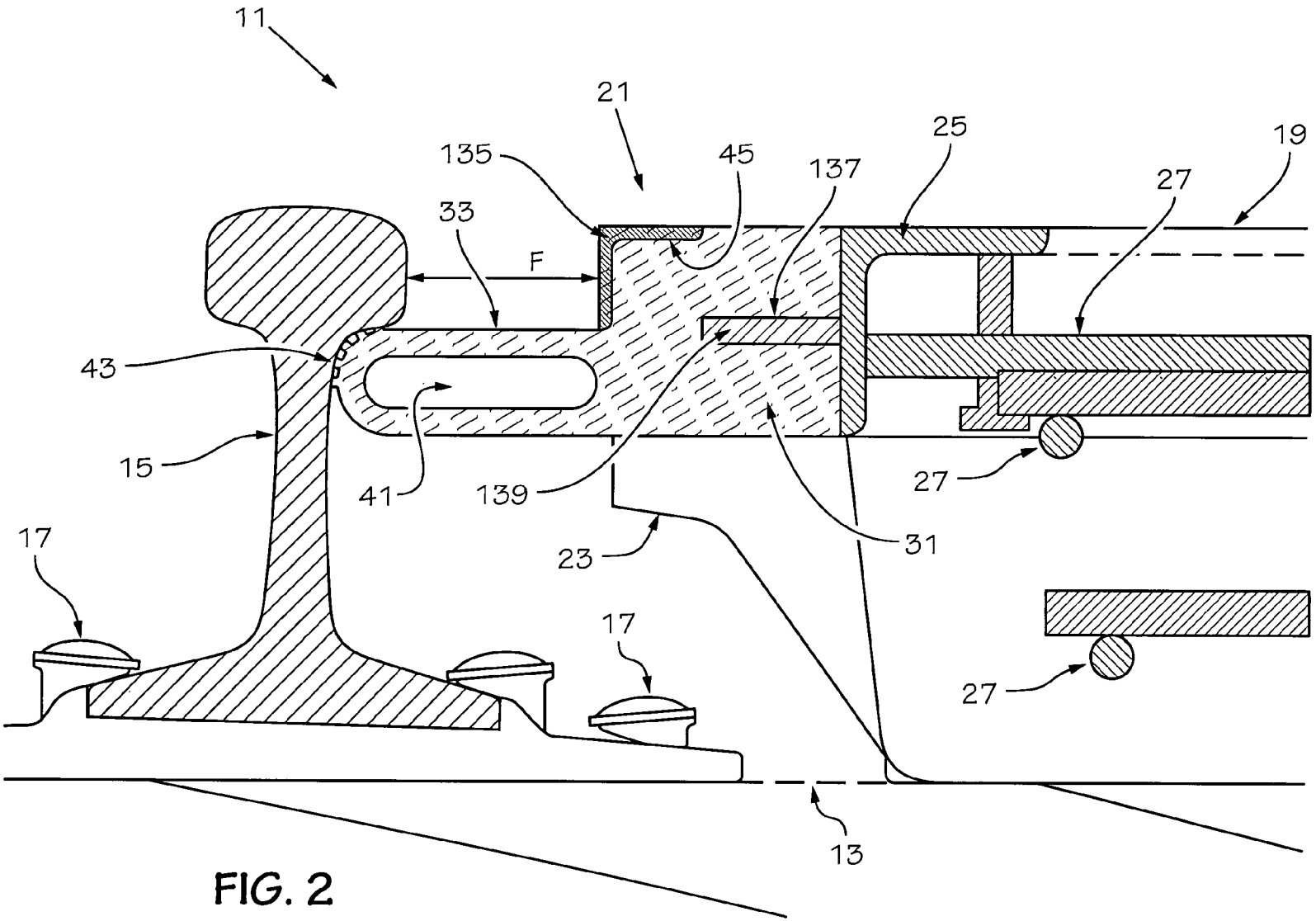
FIG. 2 is a cross-sectional view of an alternate embodiment of the railroad crossing having a UHMWPE flangeway liner according to the present invention.

Referring now to FIG. 2 in the drawings, an alternate embodiment of railroad crossing 11 having a UHMWPE liner according to the present invention is illustrated in a partial cross-sectional view. For clarity, only one side of railroad crossing 11 is illustrated. It will be appreciated that the other side is a mirror image of the side illustrated. In this embodiment, flat UHMWPE liner 35 is replaced by an angled UHMWPE liner 135. Also, void space 37 and vertical attachment bar 39 are replaced by a form fitted void space 137 and a horizontal attachment bar 139. It will be appreciated that the functionality of UHMWPE liner 135, void space 137, attachment bar 139, and the other components of railroad crossing 11 remains unchanged from the preferred embodiment described above.

The present invention provides significant advantages over the prior art, including: (1) the UHMWPE liner allows flangeway widths of less than three inches; (2) the UHMWPE liner reduces wear of flangeway components; (3) the UHMWPE liner allows the use of a rubber shock absorber; (4) the UHMWPE liner protects the concrete panel from damage; and (5) the UHMWPE liner allows flangeway widths that are smoother and safer for roadway, pedestrian, and handicapped individual traffic.

It is apparent that an invention with significant advantages has been described and illustrated. Although the present invention is shown in a limited number of forms, it is not limited to just those forms, but is amenable to various changes and modifications without departing from the spirit thereof.

What is claimed is:

1. An improved railway crossing comprising:

(a) a rail base:

(b) a pair of rail members coupled to said base by a rail clip assembly;

(c) a central panel coupled between said pair of rail members;

(d) a liner assembly including:

(1) a base portion;

(2) a pair of support arms secured to said base portion and formed of a pliable material to form a seal when engaged with said pair of rail members;

(3) a pair of liners each bonded to an upper vertical edge of said base portion a predetermined clearance distance from said pair of rail members which defines a flangeway; and (4) wherein said liner is formed of a substantially thin layer of ultra high molecular weight polyethylene material and serves to prevent wear of said base.

2. The railway crossing of claim 1, wherein sidewalls of said base portion define a void therebetween.

3. The railway crossing of claim 2, wherein sidewalls of said support arms define a void therebetween.

4. The railway crossing of claim 1, wherein the base portion is formed at least in part of rubber.

5. The railway crossing of claim 1, wherein said support arms are formed at least in part of rubber.

6. The railway crossing of claim 1, wherein said substantially thin layer of ultra high molecular weight polyethylene material comprises a thin strip fastened to said vertical edge of said base member.

7. The railway crossing of claim 1, wherein said substantially thin later of ultra high molecular weight polyethylene material comprises a thin angled member fastened to said vertical edge and an upper horizontal edge of said base member.

8. The railway crossing of claim 1, wherein said liner extends substantially along an entire length of said central panel.

9. A liner assembly for use in a railroad crossing comprising:

a base portion formed of a pliable material;

a support arm secured at an angle to said base portion and formed of a pliable material and adapted to form a seal when in contact with a rail at a railroad crossing; and a liner fastened to an upper vertical edge of said base and formed of a substantially thin layer of ultra high molecular weight polyethylene material for to preventing wear of said base during use at the railroad crossing.

10. The liner assembly of claim 9, wherein sidewalls of said base portion define an internal void.

11. The liner assembly of claim 9, wherein said base portion is formed at least in part from rubber.

12. The liner assembly of claim 9, wherein said liner is further disposed along an upper edge of said base.

13. The liner assembly of claim 9, wherein sidewalls of said support arm define an internal void.

14. The liner assembly of claim 9, wherein a distal end of said support arm includes knurling for contacting the rail at the railcrossing.

15. The liner assembly of claim 9, wherein said liner is bonded to said base portion.

* * * * *